United States Patent [19]

Teshima et al.

[11] Patent Number: 4,578,043

[45] Date of Patent: Mar. 25, 1986

[54] METHOD AND APPARATUS FOR MANUFACTURING LIGHT BULB WITH BEAD SEALING GAS

[75] Inventors: Toru Teshima; Masanobu Aizawa; Mitsunari Yoshida, all of Yokohama; Toshiyuki Shima, Kawasaki; Masakazu Takeda, Tokyo, all of Japan

[73] Assignee: Stanley Electric Co., Ltd., Tokyo, Japan

[21] Appl. No.: 705,747

[22] Filed: Feb. 26, 1985

[30] Foreign Application Priority Data

Mar. 5, 1984 [JP] Japan ..... 59-41718

[51] Int. Cl.[4] ..... H01J 9/18

[52] U.S. Cl. ..... 445/40; 445/15; 445/28; 445/57; 445/43

[58] Field of Search ..... 445/9, 15, 16, 17, 22, 445/23, 29, 32, 38, 42, 43, 53, 56, 57, 66, 70, 40

[56] References Cited

U.S. PATENT DOCUMENTS

| | | | |
|---|---|---|---|
| 3,291,548 | 12/1966 | Fraser | 445/57 |
| 3,698,784 | 10/1972 | Hamai | 445/40 |
| 4,213,663 | 7/1980 | Nubani | 445/40 |
| 4,354,717 | 10/1982 | Rech | 445/28 |

FOREIGN PATENT DOCUMENTS

| | | | |
|---|---|---|---|
| 0160079 | 12/1979 | Japan | 445/15 |
| 111665 | 4/1962 | United Kingdom | 445/43 |

*Primary Examiner*—Kenneth J. Ramsey
*Assistant Examiner*—K. Rowan
*Attorney, Agent, or Firm*—Frishauf, HOltz, Goodman & Woodward

[57] ABSTRACT

A method and apparatus for manufacturing a bulb wherein a bead mount and a glass bulb are set in a recess in an upper surface of a heater arranged inside a hermetically sealed chamber, a first gas comprised of one component of a composition of a sealing gas in the glass bulb or an inert gas excluding the sealing gas is supplied to the chamber at a predetermined pressure after the chamber is evacuated, a second gas comprised of a remaining component of the sealing gas or all of the components thereof is sprayed in a space between the glass bulb and the bead mount at a pressure higher than that of the first gas to exhaust the first gas from the space within the glass bulb. The heater is energized after the substitution of the gas within the space of the bulb is performed, or while the gas substitution in the space is being performed, in order to heat and melt an edge portion of the bead mount and glass bulb to seal the glass bulb to the bead mount with the second gas sealed within the glass bulb.

21 Claims, 12 Drawing Figures

METHOD AND APPARATUS FOR MANUFACTURING LIGHT BULB WITH BEAD SEALING GAS

BACKGROUND OF THE INVENTION

This invention relates to a method and apparatus for manufacturing a bulb with a bead sealing gas, wherein a gas is sealed in a glass bulb so as to seal the glass bulb by melting a bead. More particularly, the present invention relates to an improvement in a gas sealing process.

In a conventional light bulb with a bead sealing gas, as shown in FIG. 1, a glass bulb 1 is combined with a bead mount arranged such that a filament 3 attached to the distal ends of lead wires 2 is located at a predetermined position in the glass bulb 1. The resultant structure is evacuated, and a gas 5 is introduced therein. An opening edge portion of the glass bulb 1 and a bead 4 are heated and melted to seal the glass bulb 1. When the gas 5 is not supplied to the light bulb, a vacuum light bulb is obtained.

A conventional process for fabricating a light bulb with a bead sealing gas will be described with reference to FIG. 2. One end of a glass tube 1' is heated and melted to produce a round sealing end. The glass tube 1' is cut to a predetermined length to prepare the glass bulb 1. A small glass tube 4' is cut to a predetermined length, and the lead wires 2 are inserted through the glass tube 4'. The resultant structure of glass tube 4' and lead wires 2 is heated and melted to constitute a bead stem (bead stem manufacturing step A in FIG. 2). The filament 3 is attached to the distal ends of the lead wires 2 of the bead stem, thereby preparing a bead mount. The diameter r of the bead 4 is smaller than the inner diameter R of the glass bulb 1.

The glass bulb 1 is combined with the bead mount, and a gas is sealed therein in a gas sealing step B. As a result, a light bulb 10 with a bead sealing gas therein is prepared.

FIG. 3 is a diagram for explaining the conventional gas sealing step B of FIG. 2. Referring to FIG. 3, a chamber 11 is provided with a cover 12. When a gas is to be sealed in a glass bulb, a mechanical pressure F acts on the cover 12 to hermetically seal the chamber 11. A carbon heater 13 is supported by electrodes 14A and 14B in the chamber 11 and is connected to a power source 15 and a switch 16 located outside the chamber 11. The heater 13 has a circular recess 13A in the upper surface thereof. A light bulb is to be held in the circular recess 13A. For this purpose, a combination of the glass bulb 1 and the bead mount (the lead wires 2, the filament 3 and the bead 4) is held in the circular recess 13A.

A nitrogen gas circuit including a nitrogen gas tank 17, a pressure control valve 18, a pressure meter 19 and a valve 20 is connected to chamber 11. A sealing gas circuit including a sealing gas tank 21, a pressure control valve 22, a pressure meter 23 and a valve 24, and an evacuating circuit including a vacuum pump 25 and a valve 26 are also connected to the chamber 11. In addition, a leak valve 27, a pressure meter 28 and a vacuum meter 29 for measuring a vacuum pressure in the chamber 11 are connected to the chamber 11. The pressure meter 28 and the vacuum meter 29 are switched over by a selector valve 30.

When the gas is to be sealed in the bulb 1, the glass bulb 1 and the bead mount are set in the recess 13A of the heater 13. The cover 12 is closed and a pressure F is applied to the cover 12. In this state, the vacuum pump 25 is started to evacuate the chamber 11. The valve 26 of the evacuation circuit is closed after evacuation.

Thereafter, the sealing gas for the light bulb is supplied into the chamber 11 at a predetermined pressure from sealing gas tank 21. The sealing gas is also thereby introduced in the glass bulb 1. The switch 16 is turned on to energize the carbon heater 13 to seal the edge portion of the glass bulb 1 with the bead 4. Thus, a light bulb with a bead sealing gas is prepared.

The glass bulb 1 can be sealed with the bead 4 in a sealing gas atmosphere in the chamber 11, so that the lead wires 2 and the filament 3 will not be oxidized.

In the above-described conventional process, an expensive sealing gas is introduced in the entire space inside the chamber 11. Even if a plurality of light bulbs are prepared in a single cycle, the amount of sealing gas per light bulb is high, resulting in high cost. In particular, when the gas pressure is increased, the manufacturing cost is increased.

If a liquid nitrogen cooling method is used in the process for manufacturing a light bulb sealed with a bead, the glass is distorted due to a temperature difference between cooling and heating temperatures for sealing, resulting in cracks. Among gas sealed light bulbs, a light bulb with a butt sealing gas has been proposed. In this known technique, an evacuation pipe is connected to a vacuum pump, and a gas is introduced into the bulb while it is cooled by liquid nitrogen so as to increase a sealing gas temperature. The evacuation portion is then tipped off. However, use of liquid nitrogen results in high cost. The evacuation pipe includes a tip-off portion, so that the overall length of the bulb becomes increased. This increase of length becomes a problem in compact light bulbs.

It is an object of the present invention to provide a method and apparatus for manufacturing a high-efficiency, long-life, lost-cost, high-pressure and compact light bulb (e.g., halogen lamps) with a bead sealing gas.

SUMMARY OF THE INVENTION

According to an aspect of the present invention, there is provided a method of manufacturing a bulb with a bead sealing gas, characterized in that a bead mount and a glass bulb are set in a recess (preferably circular) in an upper surface of a heater arranged inside a hermetically sealed chamber, a first gas comprised of one component of a composition of a sealing gas in the glass bulb or an inert gas excluding the sealing gas is supplied to the chamber at a predetermined pressure after the chamber is evacuated, a second gas comprised of a remaining component of the sealing gas or all the components thereof is sprayed in a space between the glass bulb and the bead mount at a pressure higher than that of the first gas to exhaust the first gas from the glass bulb, the heater is energized after gas substitution in said space is performed or while gas substitution in said space is being performed, and the bead of the bead mount and an edge portion of the glass bulb are heated and melted to seal the glass bulb.

According to another aspect of the present invention, apparatus for manufacturing a bulb with a bead sealing gas comprises a hermetically sealed chamber; at least two gas circuits for supplying at least two predetermined gases into the chamber at predetermined pressures; an evacuating circuit for evacuating the chamber; a heater disposed in the chamber and having a recess formed in an upper surface thereof for receiving a bead mount and a glass bulb to bond together an edge portion of the bead mount and the glass bulb; means for energizing said heater; at least two gas substitution holes in said heater, said at least two gas substitution holes opening at a lower surface of the heater and extending to the upper surface of the recess of said heater; and a gas spray nozzle connected to one of said gas circuits and having a tap portion communicating with at least one of two gas substitution holes for spraying one of said gases through said at least one hole into a space between said bead mount and said glass bulb before bonding of said bead mount to said glass bulb.

DETAILED DESCRIPTION

Figure 1:
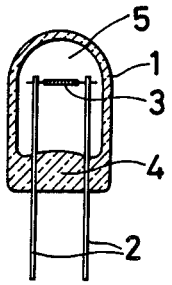
FIG. 1 (PRIOR ART)
FIG. 1 is a sectional view showing a light bulb with a bead sealed portion.
Figure 2:
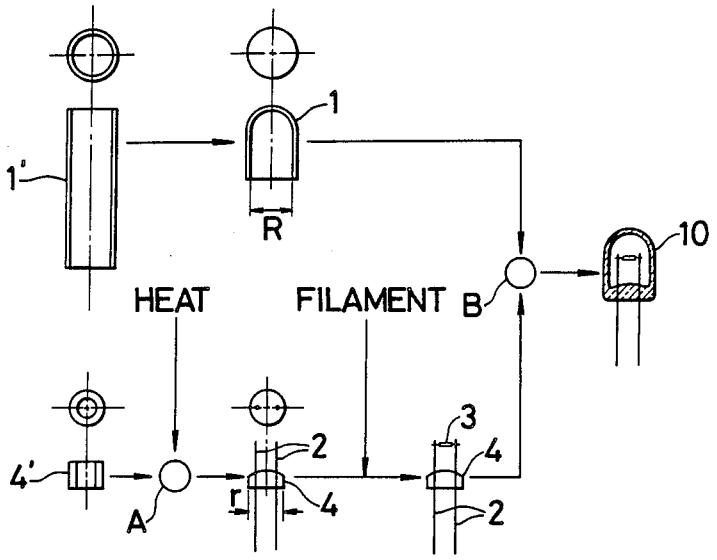
FIG. 2 (PRIOR ART)
FIG. 2 is a representation explaining the steps in fabricating a conventional light bulb with a bead sealing gas.
Figure 3:
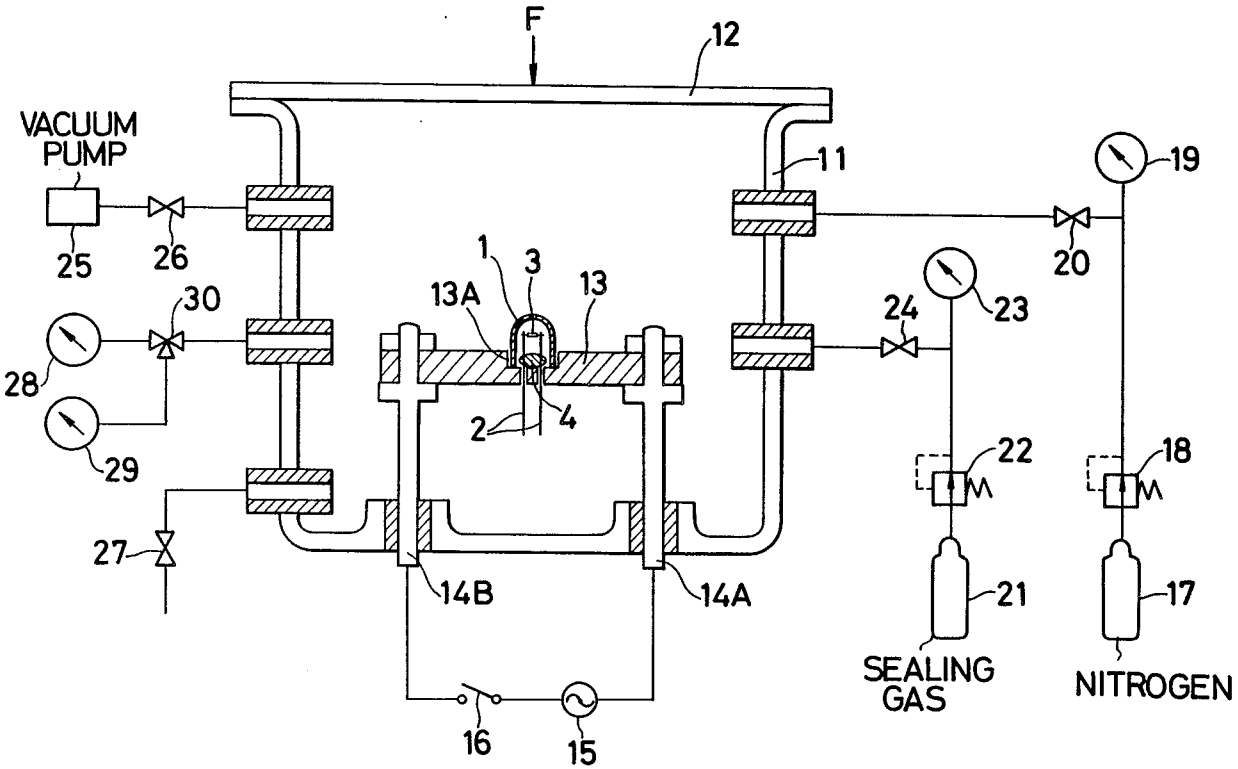
FIG.3 (PRIOR ART)
FIG. 3 is a diagram for explaining a conventional gas sealing process of a light bulb.

An exemplary embodiment of the present invention will be described with reference to FIGS. 4 to 12. The same reference numerals in FIGS. 4 to 12 denote the same parts as in FIGS. 1 to 3.

Referring to FIGS. 4 to 12, a chamber 11 is provided with a cover 12. When a gas is to be sealed in the chamber 11, the cover 12 is closed and a mechanical pressure F is exerted in the cover 12, thereby hermetically sealing the chamber 11. Electrodes 14A and 14B support a carbon heater (a bead stem heater 50 or a sealing heater 60) arranged in the chamber 11. The carbon heater is connected to an external power source 15 and an external switch 16.

A nitrogen gas circuit including a nitrogen gas tank 17, a pressure control valve 18, a pressure meter 19 and a valve 20; and an evacuation circuit including a vacuum pump 25 and a valve 27, are connected to the chamber 11. A leak valve 27, a pressure meter 28 for measuring a pressure in the chamber 11, and a vacuum meter 29 for measuring a vacuum pressure in the chamber 11 are connected to the chamber 11 in the same manner as in the conventional apparatus. The pressure meter 28 and the vacuum meter 29 are switched over by a selector valve 30 in the same manner as in the conventional apparatus.

A pair of press cylinders 31 are provided in chamber 11 for holding down the heater 50 or 60. Spring seats 32 are mounted on the inner surface of the cover 12, and coil springs 33 are mounted between press cylinders 31 and the spring seats 32 to provide a biasing force on the heater 50,60. A gas supply auxiliary member 34 is mounted below the heater 50,60.

A first gas tank 35, which constitutes a first gas circuit together with a pressure control valve 36, a pressure meter 37 and a valve 38, is coupled to a port 135 of chamber 11. The first gas tank 35 contains a first gas which comprises one component of the components constituting a sealing gas of the light bulb or any inert gas excluding the sealing gas. A second gas tank 39, which constitutes a second gas circuit together with a pressure control valve 40, a pressure meter 41 and a valve 42, is connected to an inlet port 139 of the gas supply auxiliary member 34. The second gas tank 39 contains a second gas which comprises a remaining component of the sealing gas or all the components thereof. Second gas spray nozzles 43 are detachably mounted, for example by screws 44, to the outlet port of the gas supply auxiliary member 34. The nozzle spacing corresponds to a size of the circular recess of the heater 60 (to be described in detail hereinbelow). The nozzles 43 are removed when the bead steam heater 50 is used.

Figure 5:
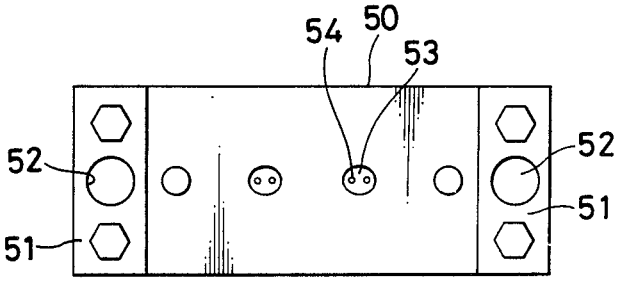
FIG. 5 is a plan view of a bead stem heater used in bead steam preparation according to the present invention.
Figure 6:
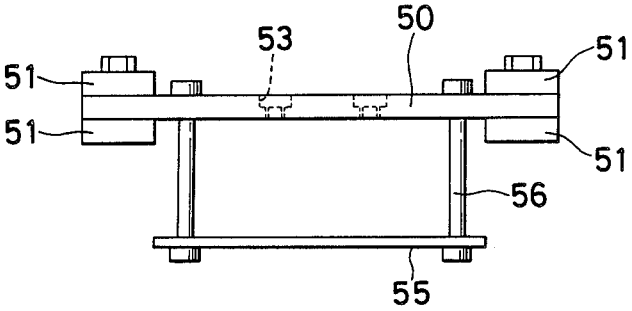
FIG. 6 is a front view thereof.
Figure 7:
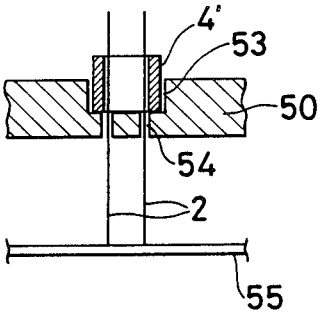
FIG. 7 is an enlarged sectional view of a small glass tube setting section of the heater of FIGS. 5 and 6.
Figure 8:
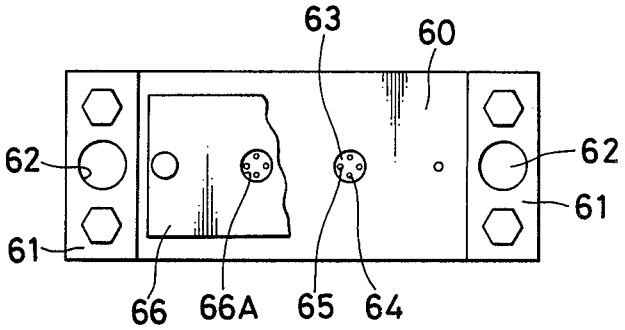
FIG. 8 is a plan view of a sealing heater used in the present invention.

As shown in FIGS. 5 to 7, a bead stem heater 50 for use in the present invention has a flat shape, and two ends of the bead stem heater 50 (carbon heater of conventional type) are clamped between copper terminal plates 51 (see FIG. 6). Electrode insertion holes 52 are formed at the two ends of the beam stem heater 50, respectively. Elliptical (or circular) recesses 53 (see FIG. 5) are formed in the upper surface of the bead steam heater 50. The recesses 53 may take any shape, depending on the shape of the bead stem. A small glass tube 4' (see FIG. 7) is inserted in each recess 53. A lead wire stopper 55 made of a carbon material is disposed below the heater 50 and is suspended from the heater 50 through insulating pins 56.

Figure 9:
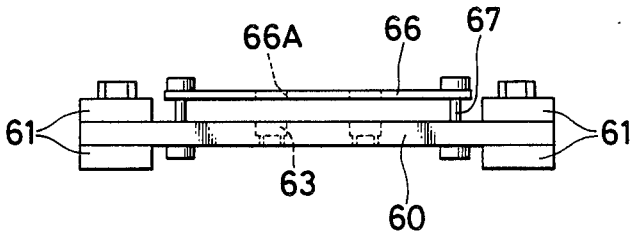
FIG. 9 is a front view thereof.
Figure 10:
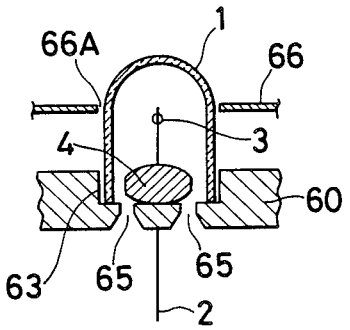
FIGS. 10 and 11 are enlarged sectional views (front and side, respectively) of glass bulbs on the sealing heaters and the bead mount setting sections, respectively.
Figure 11:
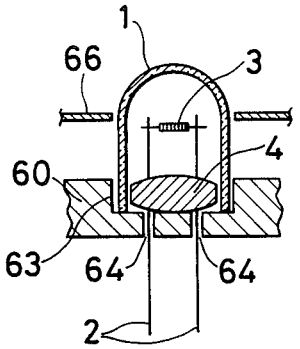

As shown in FIGS. 8 to 12, a sealing heater 60 for use in the present invention has a flat shape, and two ends of the sealing heater 60 (carbon heater of conventional type) are clamped between copper terminal plates 61 (see FIG. 9). Electrode insertion holes 62 are formed at the two ends of the sealing heater 60, respectively. Circular recesses 63 are formed in the upper surface of the sealing heater 60. The recesses 63 may take other shapes, depending upon the shape of the glass bulb to be set therein. A combination of the glass bulb 1 and the bead mount is set in each circular recess 63 (see FIGS. 10 and 11). Two lead wire insertion holes 64 and a plurality (two in this embodiment) of gas substitution holes 65 are formed in the bottom of each circular recess 63. A glass bulb holder 66 is disposed above the heater 60 and is supported through insulating pins 67. Holes 66A are formed in the holder 66 to maintain the corresponding glass bulbs in the desired position and to prevent the corresponding glass bulbs 1 from being inclined. The gas substitution holes 65 oppose the gas spray nozzles 43. The lower surface portion of the sealing heater 60 leading into the holes 65 is tapered upward and the tapered opening opposes the corresponding nozzle 43.

When bead stem preparation and gas sealing are performed by using the chamber apparatus described above, the bead steam heater 50 is installed in the chamber 11. The heater 50 is mounted across the electrodes 14*a* and 14*b*, which extend into electrode insertion holes 52. The small glass tube 4' and the lead wires 2 are set in the recess 53, as shown in FIG. 7. In this case, the second gas circuit (39,40,41,42) is not used, and the second gas spray nozzles 43 are removed.

In this state, the chamber 11 is evacuated by the vaccum pump 25, and the valve 26 is then closed. The valve 20 of the nitrogen gas circuit is then opened to supply nitrogen gas from tank 17 into the chamber 11. The bead steam heater 50 is energized in the nitrogen gas atmosphere by closing switch 16. The small glass tube 4' is heated and melted to have a shape corresponding to the elliptical (or circular) recess 53, and the lead wires 2 extend sealingly therethrough, thus preparing a bead stem. In this case, the bead 4 has an elliptical shape (since it was formed in an elliptical recess) so as to facilitate easy gas substitution at the time of sealing. However, the bead 4 may have a circular shape or other desired shape.

The filament 3 is attached to the distal ends of the lead wires to prepare a bead mount after the bead stem is formed in the same manner as in the conventional method. Thereafter, a sealing step by using a combination of the bead mount and the glass bulb 1 is performed.

Figure 4:
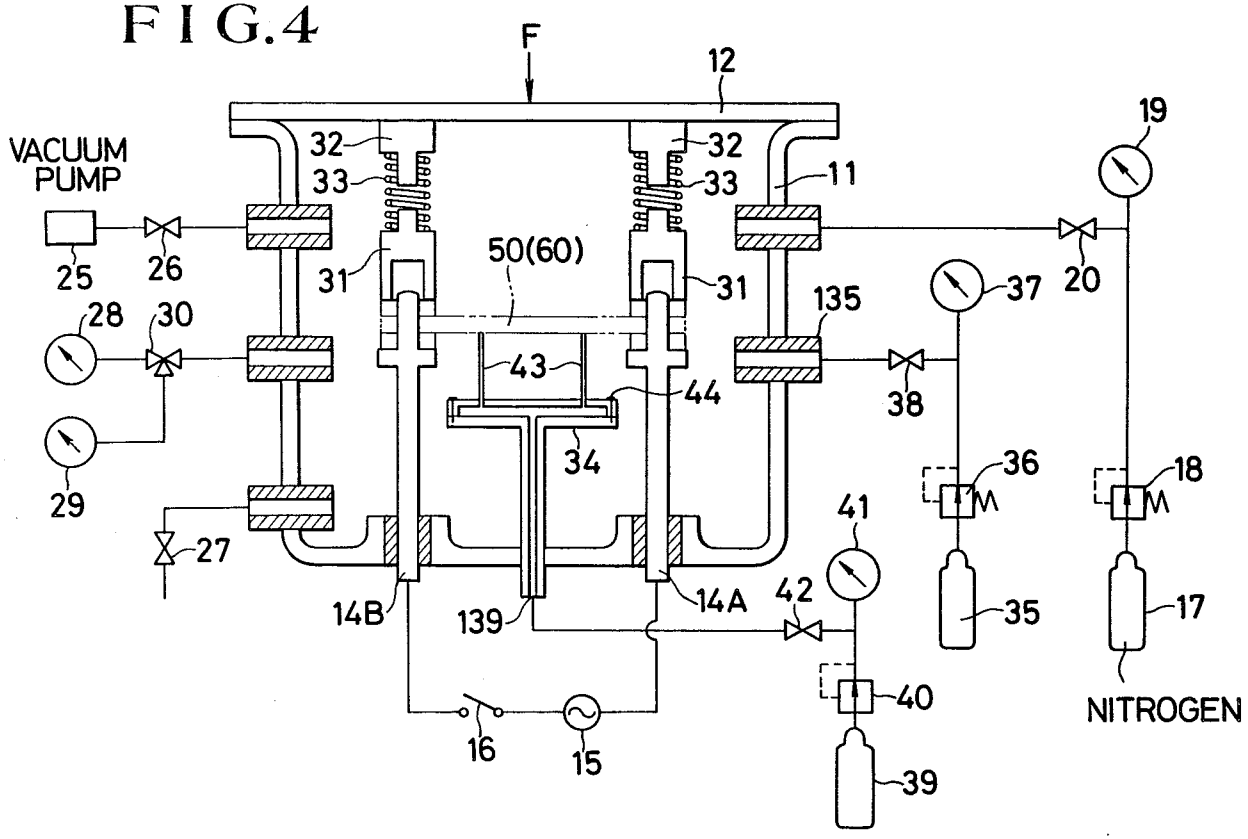
FIG. 4 is a diagram for explaining the method and apparatus for manufacturing a light bulb with a bead sealing gas according to an embodiment of the present invention.
Figure 12:
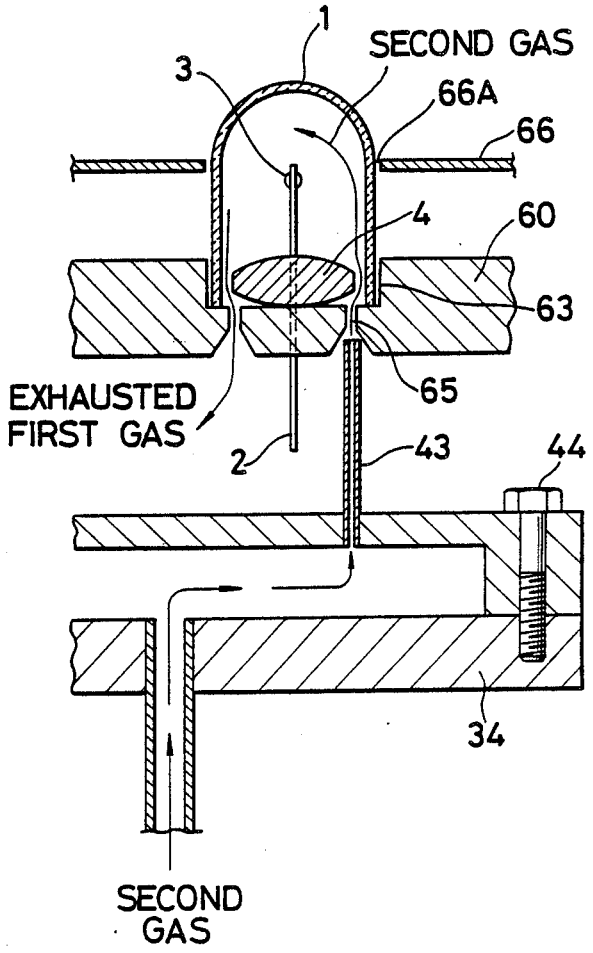
FIG. 12 is a sectional view showing a state wherein the glass bulb and the bead mount are set in the sealing heater.

In the sealing step, the bead stem heater 50 in the chamber 11 is replaced with the sealing heater 60, and the second gas spray nozzles 43 are mounted, as seen in FIGS. 4 and 12. The elliptically shaped bead mount and the glass bulb 1 are set in the circular recess 63 in the sealing heater 60. The cover 12 of the chamber 11 is closed to hermetically seal the chamber, and the sealing heater 60 is firmly fixed via springs 33 and members 31,32. Thereafter, the vacuum pump 25 is operated to evacuate the chamber 11, and the valve 26 of the evacuation circuit is then closed.

Nitrogen gas having a pressure of about 100 mmHg is introduced into the chamber from tank 17, and the sealing heater 60 is energized by closing switch 16. The bead mount and the corresponding glass bulb 1 are heated to degass the glass material and clean the inner wall surface of the glass bulb 1. In this case, a heating temperature should not exceed a glass melting point. The nitrogen gas pressure of 100 mmHg is set in consideration of good thermal conductivity at the time of heating and easy gas discharge from glass.

When the degassing operation of the glass is completed, the valve 20 is closed, and the vaccum pump 25 is operated again to sufficiently evacuate the chamber 11, thereby obtaining a sufficient vaccum pressure. When the pressure in chamber 11 has reached a predetermined vacuum pressure, the valve 26 is closed. The first gas is supplied into the chamber 11 at a predetermined gas pressure from tank 35, and the valve 38 is closed. Instead of closing the valve 38, the pressure may be controlled by the pressure control valve 36. The second gas is then supplied from tank 39 to the chamber 11 at a pressure slightly higher than that of the first gas. The second gas is sprayed from the second gas spray nozzles 43 to a spaced between the glass bulb 1 and the bead 4 through the gas substitution holes 65 (see FIGS. 10 and 12). The first gas is evacuated from the interior of glass bulb 1 upon spraying in of the second gas, as shown in FIG. 12. In other words, the first gas is replaced by the second gas. In this case, when a spraying time of the second gas is controlled, a substitution ratio can vary up to 100%.

The sealing heater 60 is energized by closing switch 16 after the gas substitution is performed at a predetermined ratio or while gas substitution is being performed. The edge portion of the glass bulb 1 and the bead of the bead mount are heated and melted to seal the glass bulb 1 to the bead 4.

Preferably, the total gas pressure of the first and second gases in the chamber 11 is slightly increased at the end of the sealing process. In this case, it is preferred to increase the pressure of the first gas (which is of lower cost than the second gas) in favor of an economical advantage. Increasing the gas pressure in the chamber after sealing prevents the softened portion of the sealed part from expanding, thereby improving the quality of the resultant bulb.

When the sealing operation is completed, the leak valve 27 is opened to discharge the gas from the chamber 11, and the cover 12 is opened. The prepared light bulb with a bead sealing gas is removed from the chamber. Before the light bulb is removed from the chamber, nitrogen gas is preferably supplied to the chamber to cool the resultant light bulb, thereby obtaining a good light bulb.

When a gas recovery circuit is connected to the leak valve 27 to recirculate the gas, the total cost can be decreased. The above steps can be automatically controlled by a sequence controller.

The following Table shows typical types of light bulbs with a bead sealing gas which can be prepared by the method of the present invention, using the specified gases and substitution ratios. These light bulbs can be applied as background illumination light sources for liquid crystal display elements, headlights of bicycles, or the like.

Table

| Type of Lamp | First Gas | Second gas | Substitution rate |
|---|---|---|---|
| Halogen lamp | Argon gas | Gas mixture (krypton gas: halogen gas) | about 60% |
| | Nitrogen gas | Gas mixture (Argon gas: krypton gas: halogen gas) | about 100% |
| Krypton lamp | Nitrogen gas | Krypton gas | about 90% |
| Xenon lamp | Nitrogen gas | Xenon gas | about 90% |

In order to obtain a predetermined pressure of a gas sealed in the light bulb, the gas pressure in the chamber can be calculated in accordance with the following equation. Reference symbol $\alpha$ is a control ratio for various conditions. The control ratio falls within the range between 0.5 and 2.0.

Gas pressure in the chamber=(sealing temperature+273° C.)/273° C.×(sealing gas pressure of bulb at room temperature)×$\alpha$.

In the above embodiment, bead stem preparation and bead sealing are performed by a single chamber. However, separate chambers may be used for bead stem preparation and bead sealing. Also, the bead stem may be prepared outside the chamber.

According to the present invention as described above, the first and second gases are supplied in a two-step manner. An inexpensive gas is used as the first gas, and an expensive gas is used as the second gas which replaces the first gas inside the bulbs. A high-efficiency, long-life bulb (e.g., halogen lamps) with a high pressure gas can thus be fabricated at low cost. The total pressure of the first and second gases is slightly increased immediately after sealing is completed, thereby preventing expansion of the sealed portion (softened glass portion), and hence contributing to high quality.

We claim:

1. A method of manufacturing a light bulb with a bead sealing gas therein, comprising:

setting a bead mount and a glass bulb in a recess in an upper surface of a heater arranged inside a hermetically sealed chamber;

evacuating said chamber;

supplying a first gas to the interior of said chamber at a predetermined pressure after said chamber is evacuated;

supplying a second gas, which includes at least one sealing gas, into a space between said glass bulb and said bead mount at a pressure higher than that of said first gas to exhaust said first gas from said space between said glass bulb and said bead mount to substitute said second gas for said first gas in said space; and energizing said heater after gas substitution is performed or while said gas substitution is being performed, so that the bead of said bead mount and an edge portion of said glass bulb are heated and melted to seal together said glass bulb and said bead mount to form a sealed bulb with said second gas sealed therein.

2. A method according to claim 1, comprising increasing the total pressure of said first and second gases in said chamber after said bead mount and said glass bulb are heated and melted to seal the glass bulb to said bead mount.

3. The method of claim 1, wherein said upper surface of said heater comprises at least two openings communicating with said recesses, and wherein said step of supplying a second gas comprises supplying said second gas at said higher pressure thereof into at least one of said openings in said upper surface of said heater, whereby said first gas from inside said space between said glass bulb and said bead mount is forced out of said space via said second opening.

4. The method of claim 3, wherein said step of supplying said second gas comprises providing a gas spray nozzle having an outlet adjacent said first opening, and supplying said second gas through said gas spray nozzle into said second opening.

5. The method of claim 1, further comprising forming said bead mount by providing a bead stem heater in said chamber, said bead stem heater having an upper surface having a recess therein; placing a glass tubular element in said recess; passing a pair of lead wires through said glass tubular element; and energizing said bead stem heater to cause said glass tubular member to melt and seal around said lead wires, thereby forming said bead mount, said bead mount then being placed on said upper surface of said first mentioned heater inside said chamber.

6. The method of claim 5, comprising supporting said lead wires from below said glass tubular member during said forming of said bead mount.

7. The method of claim 5, further comprising connecting a filament to the ends of said lead wires.

8. The method of claim 1, wherein said first mentioned heat is energized after completion of said gas substitution.

9. The method of claim 1, wherein said chamber comprises a cover and electrode means for connection to said heater, said heater being removably connectable to said electrode means; further comprising providing pressure means in said chamber and coupled to said cover for pressing said heater in engagement with said electrode means to improve the electrical contact between said heater and electrode means.

10. Apparatus for manufacturing a light bulb with a bead sealing gas therein, comprising:

means defining a hermetically sealed chamber;

a first heater arranged inside said chamber, said heater having an upper surface with a recess formed therein for receiving a glass bulb and a bead mount therein;

means for evacuating said chamber;

means for supplying a first gas to the interior of said chamber at a predetermined pressure after said chamber is evacuated;

means for supplying a second gas, which includes at least one sealing gas, into a space between said glass bulb and said bead mount, at a pressure higher than that of said first gas, to exhaust said first gas from said space between said glass bulb and said bead mount to thereby substitute said second gas for said first gas in said space; and means for energizing said first heater after said second gas is introduced into said space so that the bead of said bead mount and an edge portion of said glass bulb are heated and melted by said first heater to seal together said glass bulb and said bead mount to form a sealed bulb with said second gas sealed therein.

11. The apparatus of claim 10, comprising means for increasing the total pressure of said first and second gases in said chamber after said bead mount and said glass bulb are heated and melted to seal the glass bulb to said bead mount, to thereby prevent distortion of said light bulb.

12. The apparatus of claim 10, wherein said upper surface of said heater has at least two openings formed therein, said openings being in communication with said recess; and wherein said means for supplying said second gas includes means for supplying said second gas to at least one of said openings for causing the first gas in said space to exit from the other of said openings.

13. The apparatus of claim 12, wherein said means for supplying said second gas includes a nozzle means in communication with said at last one opening for supplying said second gas to said at least one opening.

14. The apparatus of claim 10, wherein said first heater is removably mounted in said chamber, said apparatus further comprising a bead stem heater removably mounted in said chamber in place of said first heater, said bead stem heater having an upper surface having a recess therein for forming a bead stem from a glass tubular member and a pair of lead wires passing through said glass tubular member by melting said glass tubular member.

15. The apparatus of claim 14, comprising support means mounted below said bead stem heater for supporting said lead wires during forming of said bead mount.

16. The apparatus of claim 10, wherein said energizing means energizes said first heater after said gas substitution has been completed.

17. The apparatus of claim 10, wherein said chamber comprises a cover and electrode means for connection to said first heater, said first heater being removably connectable to said electrode means; said means defining said sealed chamber further comprising pressure means in said chamber and coupled to said cover for pressing said first heater in engagement with said electrode means to improve the electrical contact between said first heater and said electrode means.

18. The method of claim 17, wherein said cover is removable, said pressure means releasing said pressure on said heater upon opening of said cover.

19. The method of claim 18, wherein said pressure means comprises at least one spring member; means for coupling said at least one spring member to said cover; and means coupled to said spring member for engaging said first heater, said spring member being interposed between said engaging means and said mounting means, for pressing said engaging means against said heater to tightly engage said first heater to said electrode means when said cover is closed.

20. The apparatus of claim 19, wherein said spring means comprises at least one coil spring.

21. The apparatus of claim 19, wherein said electrode means comprises a pair of spaced-apart rod-shaped members mounted within said chamber, and said first heater comprises at least two holes therein for receiving said rod-shaped electrode means.

* * * * *